US011440336B2

(12) United States Patent
Lau

(10) Patent No.: US 11,440,336 B2
(45) Date of Patent: Sep. 13, 2022

(54) BOOK AND METHOD THAT INDICATES AN OPEN PAGE

(71) Applicant: Yin Lung Lau, Hong Kong (CN)

(72) Inventor: Yin Lung Lau, Hong Kong (CN)

( * ) Notice: Subject to any disclaimer, the term of this patent is extended or adjusted under 35 U.S.C. 154(b) by 1183 days.

(21) Appl. No.: 15/956,774

(22) Filed: Apr. 19, 2018

(65) Prior Publication Data

US 2019/0322116 A1 Oct. 24, 2019

(51) Int. Cl.
*B42D 9/00* (2006.01)

(52) U.S. Cl.
CPC ..... *B42D 9/005* (2013.01)

(58) Field of Classification Search
USPC ..... 116/234
See application file for complete search history.

(56) References Cited

U.S. PATENT DOCUMENTS 5,707,240 A * 1/1998 Haas ..... G09B 5/062 434/409
7,290,700 B2 * 11/2007 Song ..... G09B 5/062 235/375
2005/0200116 A1 * 9/2005 Chiu ..... B42D 3/123 281/15.1
2008/0268416 A1 * 10/2008 Wallace ..... G09B 5/062 434/317
2010/0167258 A1 * 7/2010 Ravizza ..... B42B 5/12 434/317

FOREIGN PATENT DOCUMENTS

| | | | |
|---|---|---|---|
| CN | 1595420 | A | 3/2005 |
| CN | 201918043 | U | 8/2011 |
| CN | 105023470 | A | 11/2015 |
| CN | 204955798 | U | 1/2016 |

* cited by examiner

*Primary Examiner* — Daniel S Larkin
(74) *Attorney, Agent, or Firm* — Eagle IP Limited; Jacqueline C. Lui; Jennifer G. Che

(57) ABSTRACT

One embodiment is a book includes a plurality of pages, a plurality of magnets, and a sensor. The plurality of the magnets generate a combined magnetic field strength, which is variable depending on positions of the pages on which the magnets are disposed. The sensor senses the combined magnetic field strength and generates a varying signal based on a varying of the combined magnetic field strength when at least one page is moved. The varying signal indicates a position of at least one page in the book.

17 Claims, 4 Drawing Sheets

BOOK AND METHOD THAT INDICATES AN OPEN PAGE

FIELD OF THE INVENTION

This invention relates to a book and a method for indicating an open page of a book.

BACKGROUND

Despite the increase use of electronic books in various form of electronic devices, physical books with physical leaves remain popular. Physical books are the recommended reading media especially for the young generation. Instead of replacing physical books by electronic books, new methods and apparatus that assist in advancing technological needs and industrial applications in integrating electronic devices with the physical books are desirable.

SUMMARY OF THE INVENTION

One example embodiment is a book with a plurality of pages, a plurality of magnets, and a sensor. Each of the plurality of magnets is disposed at a pre-determined location of each of at least two of the plurality of pages and generates a magnetic field. The plurality of the magnets generate a combined magnetic field strength, which is variable depending on positions of the pages on which the magnets are disposed. The sensor senses the combined magnetic field strength and generates a varying signal based on a varying of the combined magnetic field strength when at least one page is moved. The varying signal indicates a position of at least one page in the book.

Another example embodiment includes a method that indicates a page of a book that is currently open, in which the book includes a plurality of pages. The method includes producing, by a plurality of magnets with each magnet disposed at each of at least two of the plurality of pages, a combined magnetic field strength; sensing, by a sensor in the book, the combined magnetic field strength; generating, by the sensor, a varying signal based on a varying of the combined magnetic field strength when at least one page is moved; and indicating, based on the varying signal, the page of the book that is currently open. The combined magnetic field strength is variable depending on positions of the pages on which the magnets are disposed.

In yet another example embodiment, a book is provided containing a plurality of pages, a first sensor magnet disposed at a back cover page of the book, a plurality of magnets and a first sensor in the book. Each magnet of the plurality of magnets is disposed at the plurality of pages and generates a magnetic field. One or more of the magnets generate a first combined magnetic field strength that acts on the first sensor magnet. The first combined magnetic field strength is variable depending on positions of the pages on which the magnets are disposed. The first sensor measures the first combined magnetic field strength and generates a first signal based on the first combined magnetic field strength. The first signal determines a position of at least one page in the book Other example embodiments are discussed herein.

DETAILED DESCRIPTION

As used herein and in the claims, "comprising" means including the following elements but not excluding others.

Example embodiments relate to apparatus and methods that indicates a page of a book that is currently open.

Example embodiments include a physical book coupled with one or more electronic devices to produce light, motion, sound, image, video, or any of their combinations when a page of the book is moved or opened. Thus, the example embodiments provide possibility for content providers to implement value added features. The value added features may not necessarily be produced at the same time when the page is opened. The value added features are, for example, auto playback of animal sounds of the wild life mentioned in a particular page; a mini game to solve the question printed on a particular physical page; auto retrieve related animations video for user to manually playback that supplements the book content after a user finished reading the page; multilingual translated voice over for the current page content etc.

Conventional or existing physical books that couple electronic devices are limited in applications. Readers are required to make transient contacts or engagements with pre-determined areas in a page of the books in order to create a signal. E.g. point to a cartoon or a designated area of the page. However, these conventional books are limited to a group of users who have the ability to comprehend and recognize the pre-determined areas in the page of the books. Example embodiments of the present invention include a plurality of magnets in pages of a book to generate a varying signal based on a varying of a combined magnetic field strength when a page is moved. In this way, the book has the ability to sense what the user is doing and provide predetermined responses according to the publisher or producer's intention without necessarily requiring any additional trigger from the user other than the turning of the page. The applications of the example embodiments are not limited to certain age groups and education sectors, etc.

Example embodiments solve the above-stated problems or difficulties by providing new methods and apparatus that integrate electronic devices with the physical books in a simple way to provide enhanced content and interactive user experience.

Figure 1:
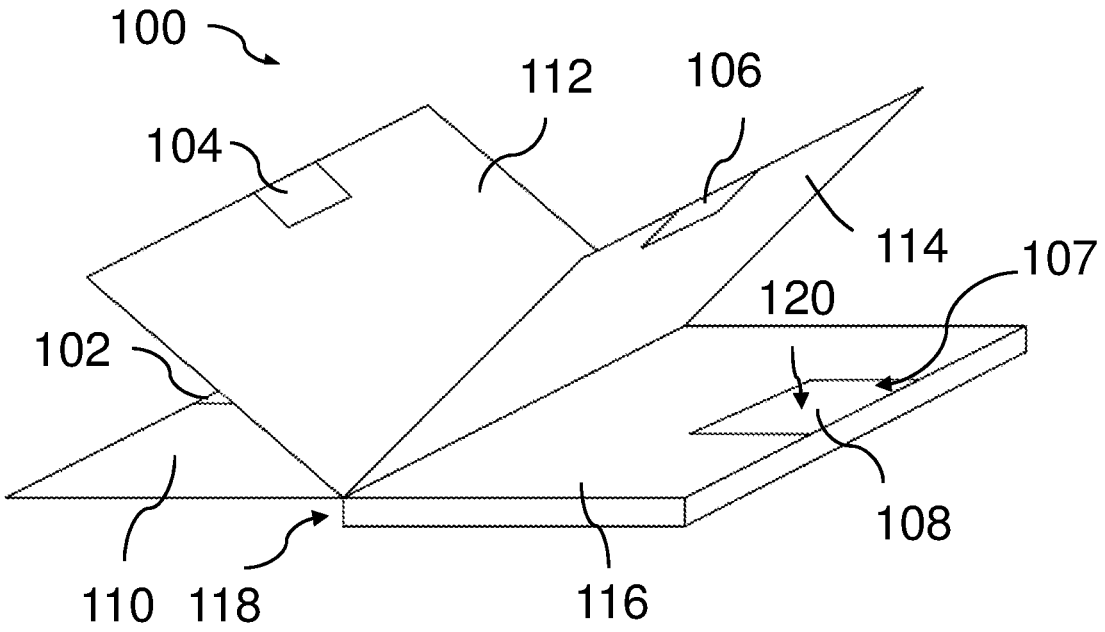
FIG. 1 shows a perspective view of a book in accordance with an example embodiment.

FIG. 1 shows a perspective view of a book 100 in accordance with an example embodiment. This example book 100 includes four pages 110, 112, 114 and 116, three magnets 102, 104, 106 and a sensor 108. Each of magnets 102, 104, 106 is disposed at the outer edge of each of the inner page and generates a magnetic field. The book 100 includes a binding side 118. In this example, the pages are the same sizes and stacked together and bound together at one side (the binding side 118) of the book 100. The three magnets 102, 104, 106 are stacked coaxially so that they are directly one above the other when the book is closed. In this configuration, the magnets generate a combined magnetic field strength that is changed depending on positions of the pages. By way of example, the sensor 108 is a magnetic field strength sensor and is set inside the last page 108 at the same position of the outer edge as the magnets. When a user opens the book, the sensor 108 is able to sense a decrease of the combined magnetic field strength as the book 100 is opened and one or more magnets stacked on the sensor 108 decreases. The sensor 108 senses the combined magnetic field strength and is able to generate a varying signal based on a varying of the combined magnetic field strength when the user moves the pages. The varying signal indicates a position of at least one page in the book 100.

In another example embodiment, the sensor 108 is a pressure sensor that includes a sensor magnet embedded at page 116. By way of example, a load (not shown but indicated by arrow 120) is provided in the book 100 at a position juxtapose the first sensor magnet. The sensor 108 measures the combined magnetic field strength that acts on the sensor magnet against a preloading force produced from the load.

In another example embodiment, the book 100 is connected with a processor (indicated by arrow 107) and a wired or a wireless power supply (not shown). The power supply provides electricity to the sensor 108 and the processor. By way of example, the power supply is a battery. The processor converts the varying signal into light, motion, sound, image, video or their combinations. In yet another example embodiment, the book 100 does not include a power supply and the sensor 108 operates without a power supply.

In yet another embodiment, computing devices or built-in electronics are embedded in the book 100 or remotely connected to the book 100. When a currently open page of the book 100 being viewed by a reader is detected or determined based on the varying of the combined magnetic field strength, the book 100 allows communications via one or more networks. Furthermore, usage or user habit on reading the book can be collected. The network can include one or more of a wired network or wireless network, such as internet, cellular network, etc.

Figure 2A:
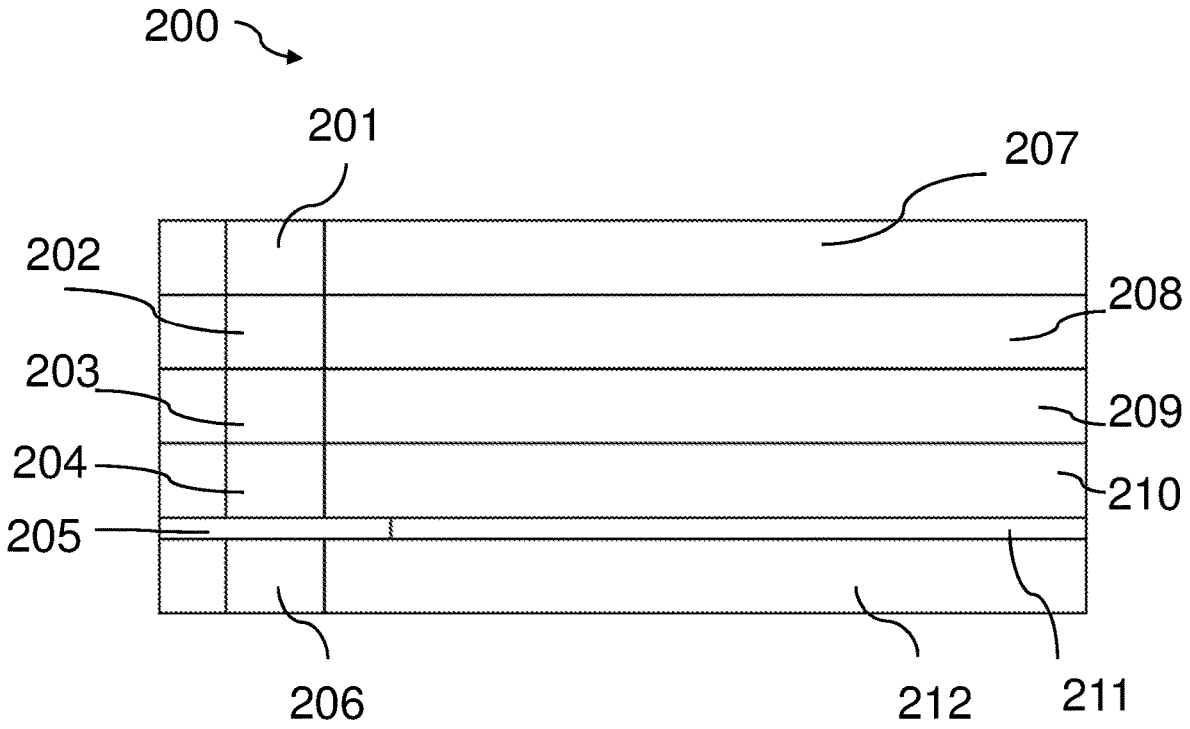
FIG. 2A shows a side view of a book in accordance with an example embodiment.
Figure 2B:
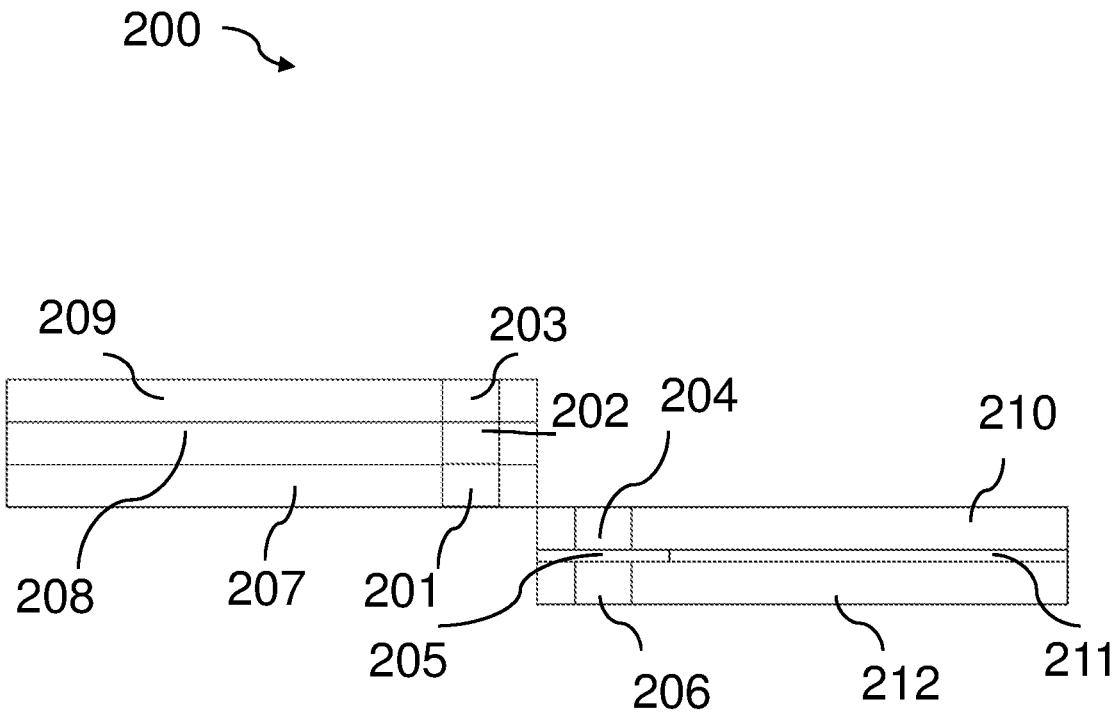
FIG. 2B shows a side view of a book in accordance with an example embodiment.
Figure 2C:
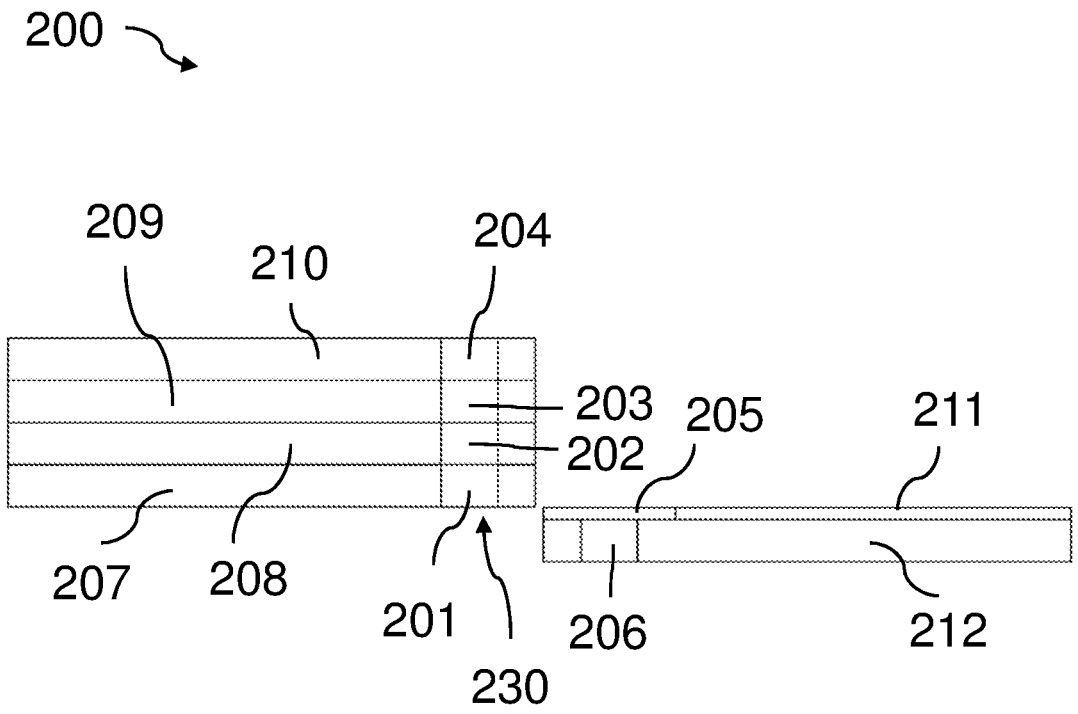
FIG. 2C shows a side view of a book in accordance with an example embodiment.

FIGS. 2A to 2C show a book 200 in accordance with an example embodiment. FIGS. 2A to 2C uses the same reference characters to indicate same elements of the example book 200. FIG. 2A shows that the book 200 is closed, FIG. 2B shows the book opened to page 210 while FIG. 2C shows the book 200 opened to page 211. The book 200 includes a plurality of pages 207, 208, 209, 210, 211, 212, a first sensor magnet 206 disposed at a back cover page 212 of the book 200, and a plurality of magnets 201, 202, 203, 204 embedded in the pages 207, 208, 209, 210 respectively. Each magnet 201, 202, 203, 204 generates a magnetic field. One or more of the magnets generate a first combined magnetic field strength that acts on the first sensor magnet 206. The first combined magnetic field strength is variable depending on positions of the pages on which the magnets are disposed. The first sensor 205 in the book 200 is embedded in the page 211. The first sensor 205 is a pressure sensor that measures the first combined magnetic field strength and generates a first signal based on the first combined magnetic field strength. The first signal determined a position of at least one page in the book. By way of example, the page 211 and the back cover page 212 are integrated into one individual sheet such that the page 211 is not able to turn over the back cover page 212 as shown in FIG. 2C.

FIG. 2A shows that the five magnets 201, 202, 203, 204, 206 are stacked coaxially when the book is closed. Magnetic dipoles of the plurality of magnets is in a same direction when the book is closed such that the plurality of magnets are attracted to each other when the book is closed. The first combined magnetic field strength that is sensed by the first sensor 205 is strongest.

FIG. 2B shows the magnet 204 is stacked coaxially with the magnet 206 when the page 210 is open, or when the page 209 is rotated or flipped away from the page 210. The first combined magnetic field strength that is sensed by the first sensor 205 decreases as the magnets stacked on the first sensor 205 decrease.

FIG. 2C shows there is no magnet that acts on the magnet 206 when the page 211 is open, or the page 210 is rotated or flipped away from the page 211. The first combined magnetic field strength that is sensed by the first sensor 205 is smallest.

By way of example, the book 200 includes a second sensor magnet (not shown but may be at, for example, position indicated by the arrow 230) attached to the outer side of the front cover page of the book. One or more of the magnets 201, 202, 203, 204, 206 generate a second combined magnetic field strength that acts on the second sensor magnet. The second sensor measures the second combined magnetic field strength that acts on the second sensor magnet and generates a second signal based on the second combined magnetic field strength. The second combined magnetic field strength is variable depending on positions of the pages on which the magnets are disposed. A difference between the first signal and the second signal indicates the position of at least one page in the book. The difference can be expressed, calculated or generated as a ratio, percentage, etc.

The methods in accordance with example embodiments are provided as examples, and examples from one method should not be construed to limit examples from another method. Further, methods discussed within different figures can be added to or exchanged with methods in other figures. Further yet, specific numerical data values (such as specific quantities, numbers, categories, etc.) or other specific information should be interpreted as illustrative for discussing example embodiments. Such specific information is not provided to limit example embodiments. For example, the sensor can be disposed in one of the plurality of pages and not necessarily be disposed in any of the cover pages. Also, the sensor is not necessarily to be stacked by one or more of the plurality of magnets, but is put within a close proximity that can successfully sense a varying of magnetic field strength. Also, the sensor can be any sensor that is able to sense a varying of magnetic field strength or any device that detects changes of magnetic field strength and send the information to other electronics. In addition, the plurality of pages can be composed of the plurality of magnets such that each magnet forms as a page in the book. Furthermore, the magnets disposed at each of the plurality of pages can be done by attachment, adhesion, embedment, affixing or any means that place the magnets at the pre-determined locations. Also, by way of example, the sensor, the first sensor or the second sensor in the example embodiments can be a pressure sensor, a magnetoresistive sensor, a magnetometer, a Hall effect sensor or a magnetic field sensor that include but is not limited to a passive and an active sensor.

As used herein, "binding side" means an edge of a book that bound or assemble a stack of individual pages of the book.

As used herein, "coaxial" refers to having a common axis or coincident axis. For example, when two magnets are stacked "coaxially", they do not necessarily be completely overlap each other but one partially covers the another.

As used herein, "front cover page" and "back cover page" refer to two opposing sides of a book and are interchangeable. For example, the "front cover page" in an example embodiment does not necessarily mean a beginning of the book, but refer to an opposing side of the "back cover page".

As used herein, "magnet" refers to any magnetic materials that include but are not limited to electromagnets and permanent magnets.

As used herein, "indicates", "indication" or "indicating" does not necessarily refer to the user, it can refer to a processor that makes a conversion of the signal.

As used herein, "sensor magnet" can be a magnet, a ferromagnetic material or a ferrimagnetic material. Examples of ferromagnetic materials are cobalt, iron, iron (III) oxide, iron(II,III) oxide, bismuth, nickel, yttrium iron garnet, chromium(IV) oxide, gadolinium, terbium, dysprosium, europium oxide, MnAs, MnSb, MgOFe2O3, CuOFe2O3, or NiOFe2O3. An example of a ferrimagnetic material is magnetite.

The invention claimed is:

1. A book, comprising:

a plurality of pages;

a plurality of magnets, wherein each magnet is disposed on a pre-determined location of each of at least two of the plurality of pages and generates a magnetic field, the plurality of the magnets generate a combined magnetic field strength, the combined magnetic field strength is variable depending on positions of the pages on which the magnets are disposed; and a sensor that senses the combined magnetic field strength and generates a varying signal based on a varying of the combined magnetic field strength when at least one page is moved, wherein the sensor comprises a sensor magnet;

wherein a load is provided in the book at a position juxtapose the sensor magnet, wherein the sensor is a pressure sensor that measures the combined magnetic field strength acting on the sensor magnet against a preloading force produced from the load; and wherein the varying signal indicates a position of at least one page in the book.

2. The book of claim 1, wherein the plurality of magnets are stacked coaxially when the book is closed.

3. The book of claim 1, further comprising a binding side, wherein the pre-determined location of each of at least two of the plurality of pages is at a same position in respect to the binding side of the book.

4. The book of claim 1, wherein the plurality of pages are composed of the plurality of magnets such that each magnet forms as a page in the book.

5. The book of claim 1, wherein the sensor is disposed in one of the plurality of pages and the sensor senses a decrease of the combined magnetic field strength as the book is opened and one or more magnets stacked on the sensor decreases.

6. The book of claim 1, wherein magnetic dipoles of the plurality of magnets is in a same direction when the book is closed such that the plurality of magnets are attracted to each other when the book is closed.

7. The book of claim 1, further comprising:

a processor that converts the varying signal into light, motion, sound, image, video or their combinations.

8. A method that indicates a page of a book that is currently open, wherein the book includes a plurality of pages, the method comprising:

providing a first sensor comprising a first sensor magnet in the book, and a second sensor comprising a second sensor magnet in the book;

producing, by a plurality of magnets with each magnet disposed on at least two of the plurality of pages, a first combined magnetic field strength and a second combined magnetic field strength that act on the first sensor magnet and the second sensor magnet respectively, wherein the first combined magnetic field strength and the second combined magnetic field strength are variable depending on positions of the pages on which the magnets are disposed;

sensing, by the first sensor in the book, the first combined magnetic field strength that acts on the first sensor magnet;

generating, by the first sensor, a first signal based on the first combined magnetic field strength;

sensing, by the second sensor in the book, the second combined magnetic field strength that acts on the second sensor magnet;

generating, by the second sensor, a second signal based on the second combined magnetic field strength; and indicating, based on the difference between the first signal and the second signal, the position of the page of the book that is currently open.

9. The method of claim 8, wherein the plurality of magnets are stacked coaxially when the book is closed.

10. The method of claim 8, wherein the first sensor magnet is disposed at a back cover page of the book, and the second sensor magnet is disposed at a front cover page of the book.

11. The method of claim 8, wherein magnetic dipoles of the plurality of magnets is in a same direction when the book is closed such that the plurality of magnets are attracted to each other when the book is closed.

12. The method of claim 8, wherein the first sensor and the second sensor are selected from a group consisting of a pressure sensor, a magnetoresistive sensor, a magnetometer, a Hall effect sensor and a magnetic field sensor.

13. The method of claim 8, further comprising:

converting, by a processor, the first signal and the second signal into light, motion, sound, image, video or their combinations.

14. A book, comprising:

a plurality of pages;

a first sensor magnet disposed at a back cover page of the book;

a second sensor magnet disposed at a front cover page of the book;

a plurality of magnets, wherein each magnet is disposed at the plurality of pages and generates a magnetic field, one or more of the magnets generate a first combined magnetic field strength and/or a second combined magnetic field strength that act on the first sensor magnet and/or the second sensor magnet respectively, the first combined magnetic field strength and the second combined magnetic field strength are variable depending on positions of the pages on which the magnets are disposed;

a first sensor in the book that measures the first combined magnetic field strength and generates a first signal based on the first combined magnetic field strength; and a second sensor that measures the second combined magnetic field strength that acts on the second sensor magnet and generates a second signal based on the second combined magnetic field strength, wherein the first signal determines a position of at least one page in the book wherein a difference between the first signal and the second signal indicates the position of at least one page in the book.

15. The book of claim 14, further comprising:

a load provided in the book at a position juxtapose the first sensor magnet, wherein the first sensor is a pressure sensor that measures the first combined magnetic field strength acting on the first sensor magnet against a preloading force produced from the load.

16. The book of claim 14, wherein the plurality of magnets are stacked coaxially when the book is closed.

17. The book of claim 14, wherein magnetic dipoles of the plurality of magnets is in a same direction when the book is closed such that the plurality of magnets are attracted to each other when the book is closed.

* * * * *